US006318208B1

(12) United States Patent
Thongs, Jr. et al.

(10) Patent No.: US 6,318,208 B1
(45) Date of Patent: Nov. 20, 2001

(54) LOW PROFILE ELECTRONIC THROTTLE PEDAL

(75) Inventors: Lawrence C. Thongs, Jr., Hillsboro; James G. Honyak, Salem, both of OR (US)

(73) Assignee: Williams Controls Industries, Inc., Portland, OR (US)

( * ) Notice: Subject to any disclaimer, the term of this patent is extended or adjusted under 35 U.S.C. 154(b) by 0 days.

(21) Appl. No.: 09/517,745

(22) Filed: Mar. 3, 2000

(51) Int. Cl.[7] ..... G05G 1/14
(52) U.S. Cl. ..... 74/513; 74/560
(58) Field of Search ..... 74/513, 560, 514, 74/512, 561

(56) References Cited

U.S. PATENT DOCUMENTS 3,398,817 * 8/1968 Shinga ..... 74/513
5,063,811 * 11/1991 Smith et al. ..... 74/513
5,497,677 * 3/1996 Baumann et al. ..... 74/513
5,666,860 * 9/1997 Baumann et al. ..... 74/513

* cited by examiner

*Primary Examiner*—Mary Ann Green
(74) *Attorney, Agent, or Firm*—Shoemaker and Mattare

(57) ABSTRACT

A low profile electronic throttle pedal assembly for vehicles includes a base plate mounted on the floor of the vehicle and a throttle treadle pivotally mounted on the base plate. The treadle includes a lower lever arm portion extending through the base plate into a space beneath the vehicle floor. A throttle position sensor as well as the drive mechanism connecting lever arm with the sensor are both carried on the bottom side of the plate, beneath the vehicle floor. Treadle return springs pass through the plate and are seated beneath the vehicle floor.

20 Claims, 6 Drawing Sheets

LOW PROFILE ELECTRONIC THROTTLE PEDAL

TECHNICAL FIELD

The present invention broadly relates to manually operated controls, and deals more particularly with a low profile electronic throttle control pedal assembly for vehicles.

BACKGROUND OF THE INVENTION

Electronic throttle control pedals are well-known in the art, and are being used with increasing frequency in vehicles due to the trend towards electronically controlled engines. Rather than employing a mechanical linkage to connect the throttle pedal with the vehicle's engine, electronic throttle pedals are electrically linked to the vehicle's ECU (Electronic Control Unit), which in turn controls throttle settings on the engine. These known throttle pedals employ an electronic sensor, typically a potentiometer, which converts mechanical movement of the throttle pedal into an electrical signal representative of the pedal position, and thus of the desired throttle setting. This signal, which may be in the form of a digital, analog or PWM format, is forwarded to the engine's ECU either by a discrete wire, or via a data bus along with other control signals.

Electronic throttle pedals of the type described above are traditionally mounted either on the floor of the vehicle's passenger compartment, or are suspended in a cantilever fashion from the vehicle's firewall. Because the electronic pedal position sensor is mounted directly on the mechanical pedal assembly, packaging issues sometimes arise in those applications where the available envelope of space for the pedal is small or narrow. Consequently, efforts have been made to design and layout the pedal components in a manner which yields a compact assembly of desired dimensions.

Most recently electronically controlled engines have found use in off-road and industrial vehicles such as, for example, fork lift trucks. In these applications, a different set of considerations control electronic pedal design because of the harsher operating environments and different functional requirements that apply to pedal design for these applications. For example, in the case of a fork lift truck, different parts of the pedal assembly, such as the electronic sensor my be exposed to the surrounding environment and are subject to physical impact, and component loading not typically found in on-road vehicle applications. Moreover, bulky pedal assemblies can present an obstacle on the floor of the vehicle that may interfere with the operator's movements, either in controlling the vehicle or mounting and dismounting the vehicle.

The present invention provides an improvement in electronic control throttle pedal designs which is particularly suited for off-road and industrial vehicle applications where a simplified, low profile pedal is desirable.

SUMMARY OF THE INVENTION

In accordance with one aspect of the invention, a low profile, electronic throttle pedal assembly for vehicles is provided, comprising a base adapted to be mounted on the floor of the vehicle and a treadle pivotally connected to the base. The pedal assembly includes has an upper, treadle portion adapted to be contacted by the operator, and a lower treadle portion that extends down through the floor into a space therebeneath. An electronic throttle position sensor, along with a drive link mechanism connected to the lower portion of the treadle is mounted on the base, but beneath the floor level. The base includes a flat plate having an opening in one end thereof through which the lower portion of the treadle extends, such that only a base plate and the upper treadle portion are exposed above the vehicle floor. The linkage preferably includes first and second, interconnected links for translating pivotal movement of the treadle into rotation of an input shaft to the position sensor.

According to another aspect of the invention, a low profile electronic throttle pedal assembly for a vehicle comprises a base plate adapted to be mounted on the floor of a vehicle, and a treadle having an upper treadle portion above the plate as well as a lower portion extending downwardly through an opening in the plate to an area beneath the floor. A hinge carried on the plate mounts the treadle for pivotal movement between a closed throttle position and a wide-open throttle position. A pedal position sensor mounted on the bottom of the plate, beneath the floor senses the pivotal position of the treadle and outputs an electrical signal related to the sensed position of the treadle. The lower portion of the treadle extending beneath the vehicle floor includes a lever arm acting on a linkage which converts the pivotal motion of the treadle into rotation of an input shaft to the sensor. The base plate preferably includes a recess therein extending beneath the level of the floor, for receiving and retaining one or more compression springs which bias the treadle towards its closed throttle position.

Accordingly, it is the primary object of the present invention to provide electronic throttle control pedal possessing a low profile.

Another object of the invention is to provide a pedal of the type described above which mounts directly on the floor of a vehicle and presents a minimal number of components above the floor level.

Another object of the invention is to provide a pedal as described above in which the electronic pedal position sensor and associated drive mechanisms are concealed beneath the vehicle's floor.

Yet another object of the invention is to provide an electronic throttle control pedal of the type mentioned above which is particularly rugged and durable, and which employs a minimum number of component parts.

These, and other objects and advantages of the present invention will be made clear or will become apparent during the course of the following description of a preferred embodiment of the invention.

BRIEF DESCRIPTION OF THE DRAWINGS

In the drawings which form an integral part of the specification and are to be read in conjunction therewith, and in which like reference numerals are employed to designate identical components in the various views.

DESCRIPTION OF THE PREFERRED EMBODIMENT

Figure 8:
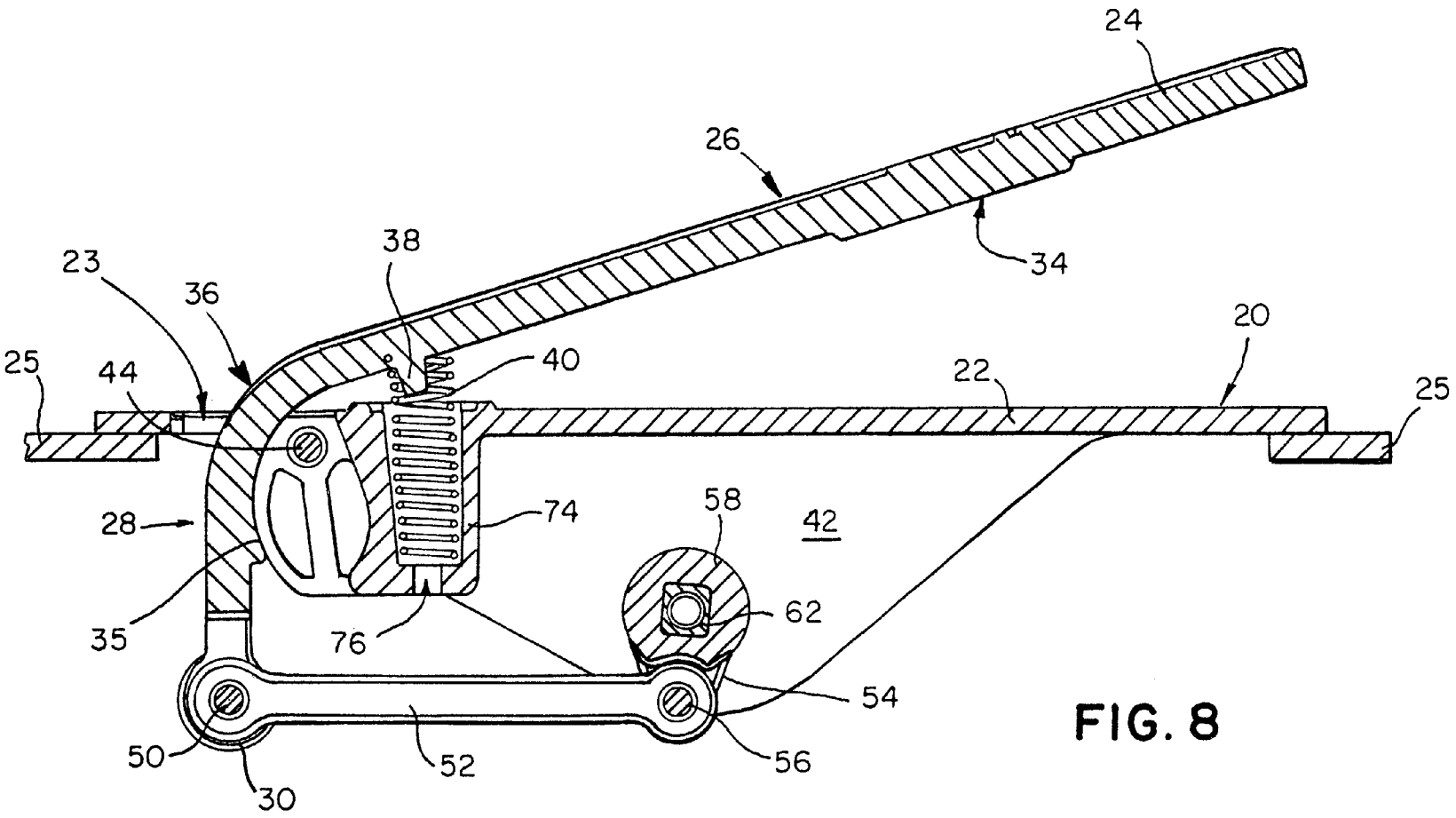
FIG. 8 is a view taken along the line 8—8 in FIG. 6.

Referring now to the drawings, a low profile electronic throttle control pedal assembly broadly comprises a base 20 which includes a base plate 22, and a treadle 24 which includes an upper portion 26, an intermediate, arcuate portion 36, and a lower lever portion 28. The pedal is mounted on a floor 25 of a vehicle (not shown) by means of fasteners (not shown) which secure the bottom face of the base plate 22 to the upper surface of the floor 25. The rearward end of the base plate 22 includes a generally rectangular opening 23 therein which communicates with an open space beneath the floor 25. The intermediate portion 36 of the treadle 24 extends downwardly through the base plate opening 23 and is pivotally connected to the base 20 by means of a pivot pin 44 extending through transverse through holes 33 in mounting ears 32 on the intermediate treadle portion 36, and a through hole extending transversely through a body 74 that is formed integrally with and extends downwardly from the base plate 22. Thus, as best seen in FIG. 8, the treadle 24 pivots about an axis slightly below the plane of the base plate 22.

Figure 7:
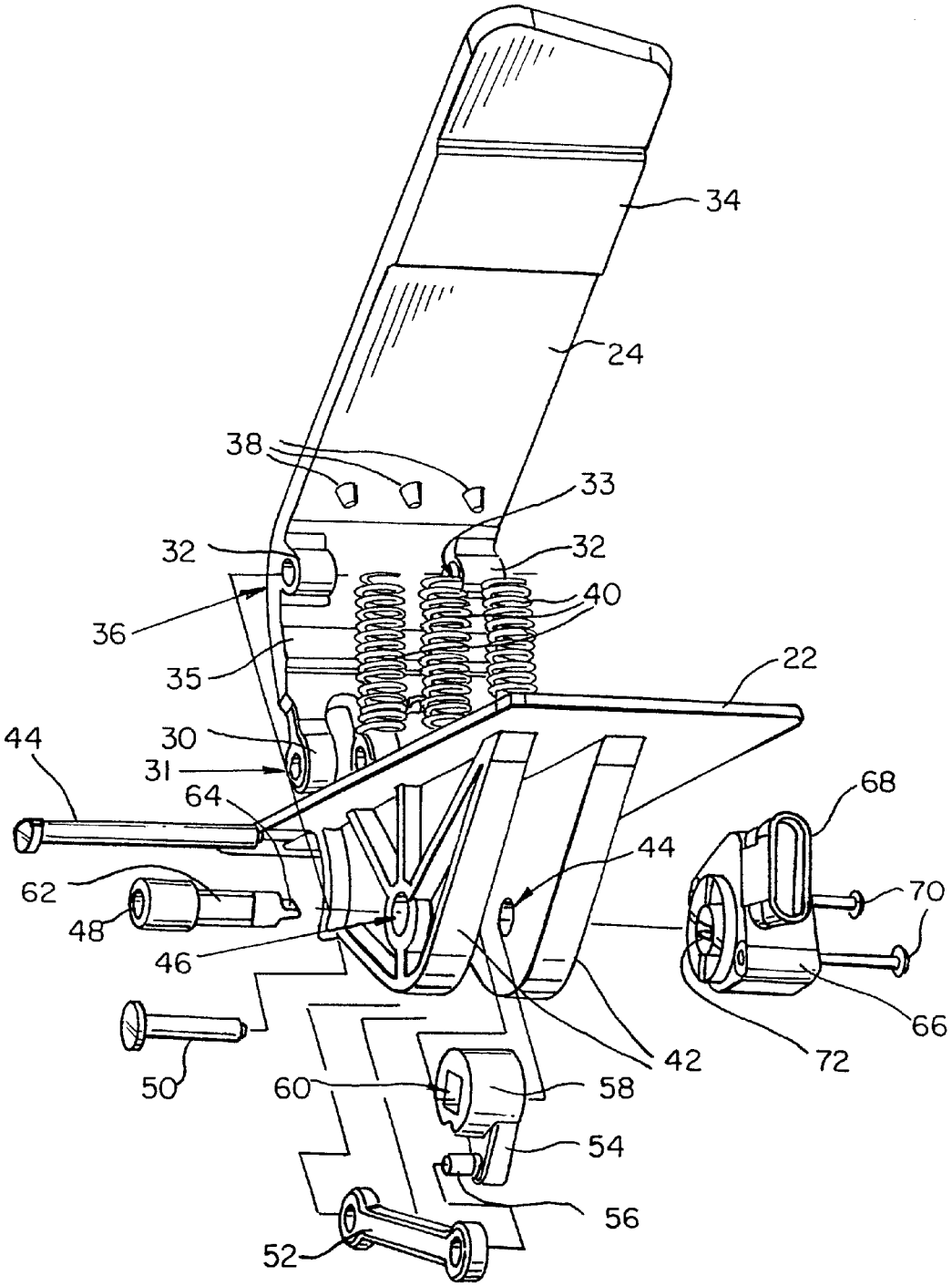
FIG. 7 is an exploded, perspective view of the pedal shown in FIG. 1.

Depending downwardly from the lower surface of the upper treadle portion 26 is an integrally formed wide open throttle stop 34, located generally in the area between where the ball of an operator's foot would be placed. Throttle stop 34 contacts the upper surface of the base plate 22 when the treadle 24 is displaced to its extreme downward position. Similarly, an integrally formed closed throttle stop 35, protrudes forwardly from the inner surface of the lower treadle portion 28. The closed throttle stop 35 contacts a rear portion base body 74 at the closed throttle position, thereby limiting the forward motion of the lower treadle portion The lower lever portion 28 of the treadle 24 includes a bifurcated-like clevis 30 that is pivotally connected to an elongated drive link 52 by means of a pivot pin 50 which extends through openings 31 (FIG. 7) in the clevis 30, as well as through a hole in one end of link 52. The other end of link 52 is pivotally connected, by means of a pivot pin 56 to another link in the form of a crank arm 54 which depends from a cylindrically shaped hub 58 having a through hole 60 transversely therethrough. Hub 58 is pivotally mounted between a pair of supports 42 by means of an axle 48 which passes through transverse openings 46 and 42, as well as the through holes 60 and hub 58. An intermediate section 62 of axle 48 possesses a rectangular cross section that is essentially identical to that of the through hole 60, while the outer end of axle 48 includes a tine 64 that is received within a slot-like opening 72 of an electronic pedal position sensor 66. The tine 64 interconnects the axle 48 with a shaft (not shown) internal to the sensor 66 which converts rotational movement of axle 48, which is indicative of the rotational position of the treadle 24, into an electrical signal that is output to an electrical cable (not shown) that is connected to the sensor 66 by means of a cable connector 68. The sensor 66 is secured to an outer side of one of the supports 42 by means of connectors such as the screws 70.

Figure 1:
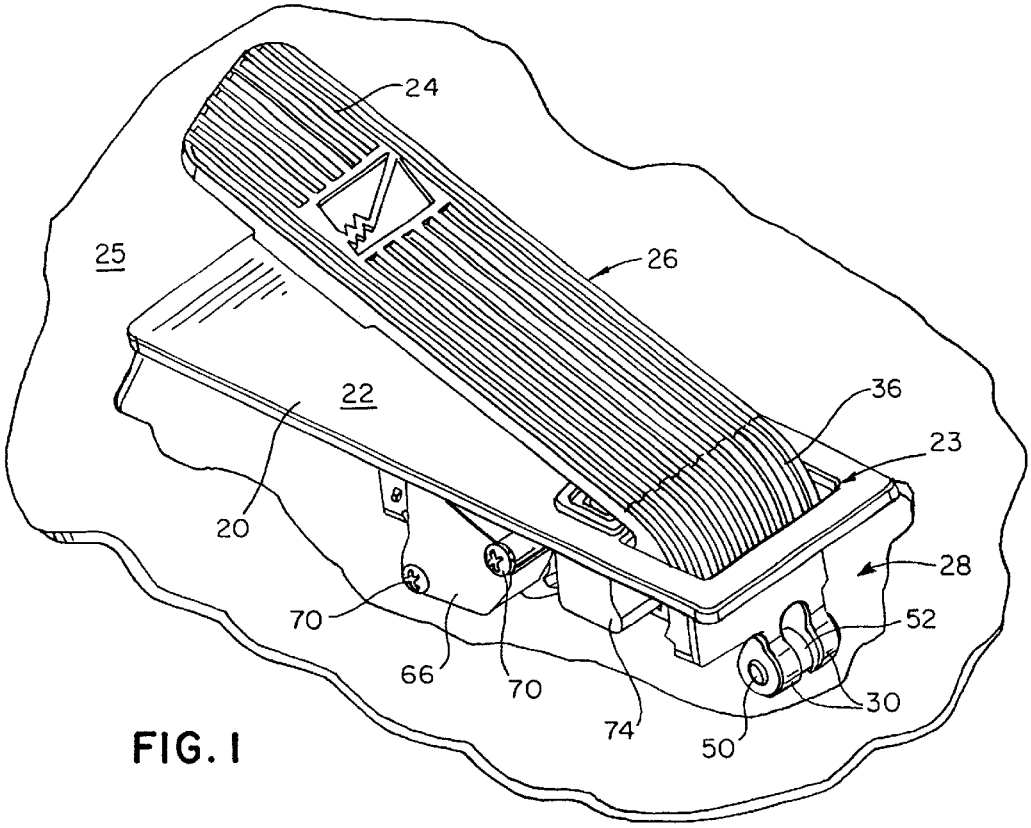
FIG. 1 is a perspective view of a low profile electronic throttle control pedal in accordance with the present invention shown mounted on the floor of a vehicle, parts of the floor being broken away to reveal concealed components of the pedal.
Figure 2:
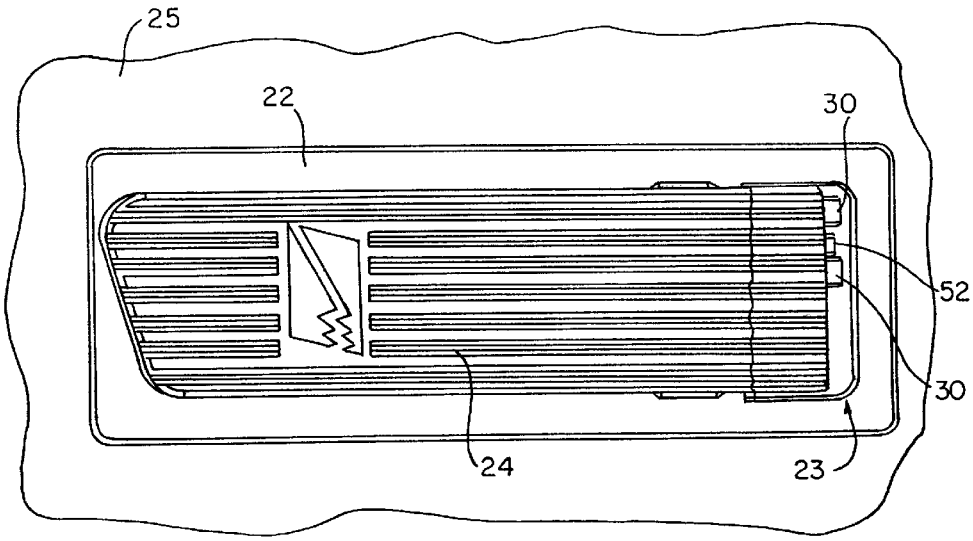
FIG. 2 is a plan view of the pedal shown in FIG. 1.
Figure 3:
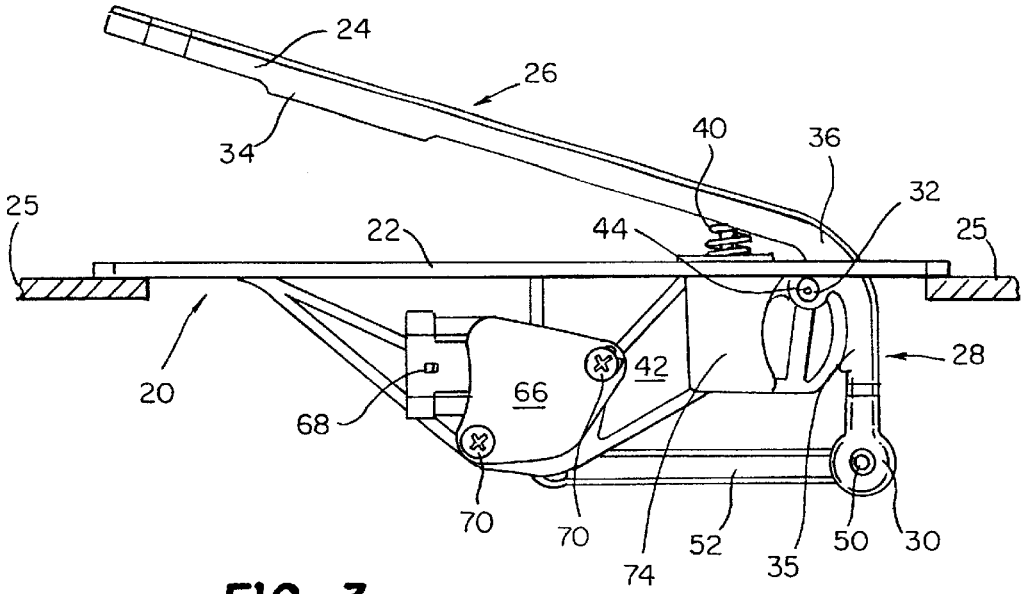
FIG. 3 is an elevational view of one side of the pedal shown in FIG. 1, the pedal being shown in the closed throttle position thereof.
Figure 4:
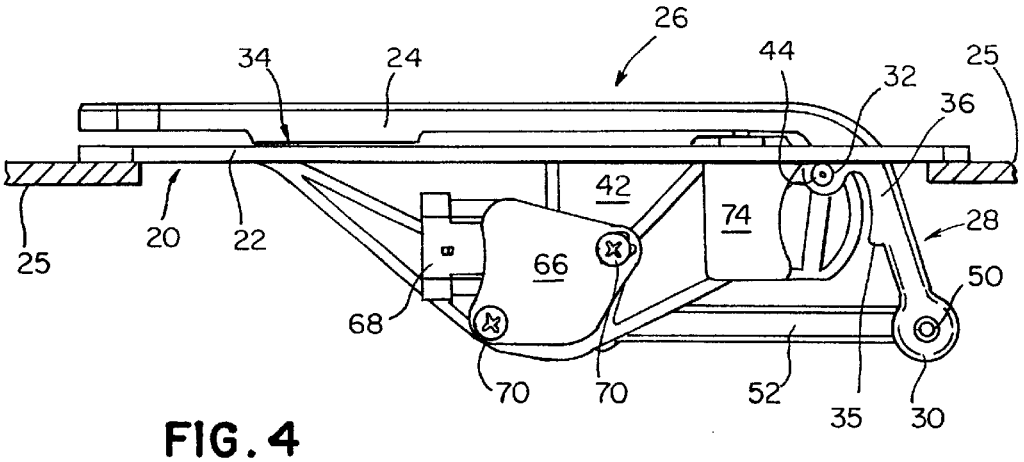
FIG. 4 is a view similar to FIG. 3 but showing the pedal fully depressed, in a wide-open throttle position thereof.
Figure 5:
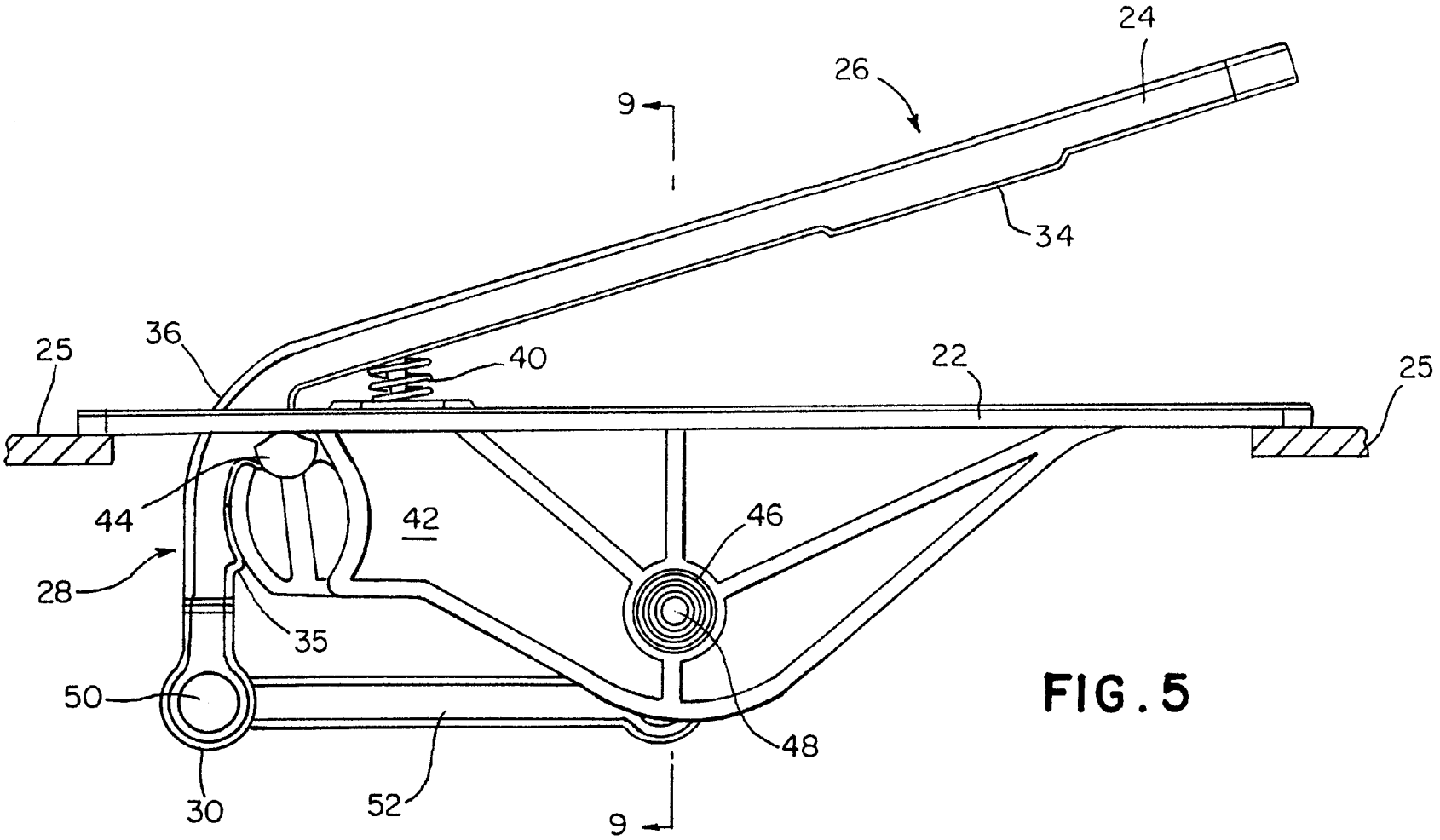
FIG. 5 is an elevational view of the other side of the pedal shown in FIG. 1.
Figure 9:
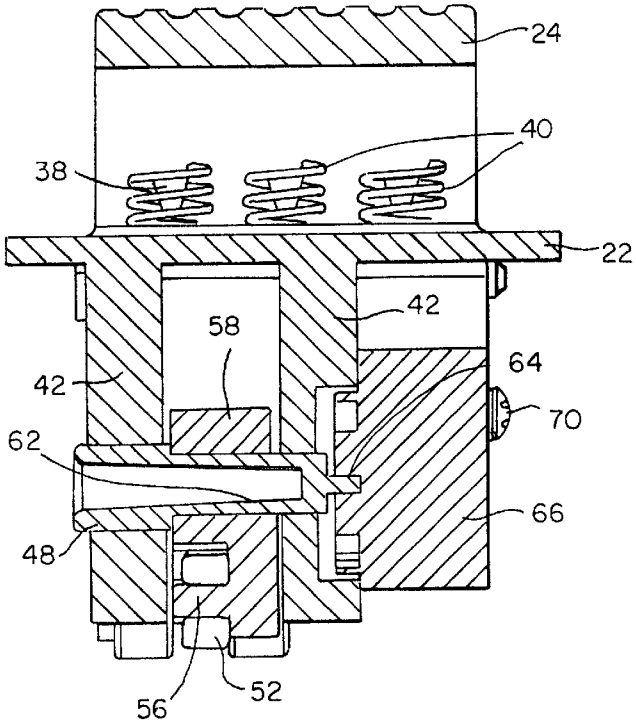
FIG. 9 is a sectional view taken along the line 9—9 in FIG. 5.
Figure 6:
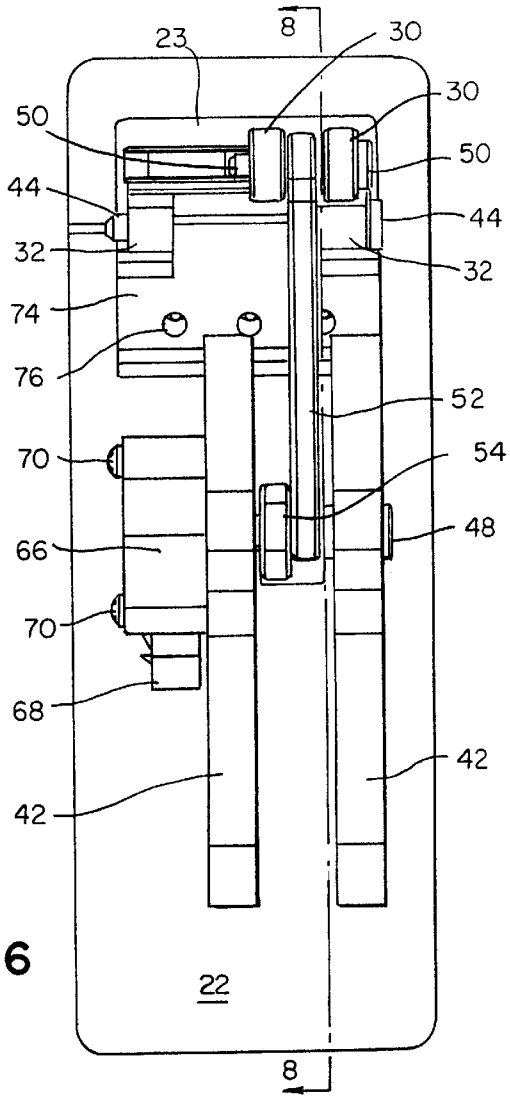
FIG. 6 is a bottom view of the pedal shown in FIG. 1.

In order to bias the pedal 24 to return to its normal, closed throttle position shown in FIG. 3, one or more compression springs 40 are positioned between the lower face of the treadle portion 26 and the base 22. More specifically, the lower portion of the springs 40 are seated within 3 corresponding recesses in the body 74. Drain holes 76 are provided in each of the spring recesses in order to allow the escape of any fluids that might enter the recesses. The upper ends of the springs 40 are held in place against the treadle 26 by means of nipples 38 which extend downwardly into the center of the corresponding spring 40, thereby restraining the upper ends of springs 40 against lateral movement.

The pedal position sensor 66 may be any of various types commercially available and well known in the art. For example, the sensor 66 may employ a contact-type potentiometer in which the internal shaft thereof rotates electrical contacts over a conductive track present on a ceramic or other substrate. Alternatively, the sensor 66 may comprise a non-contact type sensing device employing Hall-Effect devices or the like.

Treadle 24, base 20 and link 52 may be formed of any of various materials as by casting aluminum or zinc, or injection molding plastic materials, such as a glass reinforced nylon. In any event, in order to simplify pedal construction, reduce component parts and optimize packaging, the lever portion 28 of the treadle 24 is formed integral with the upper treadle portion 26. For these same reasons, the base 20 is preferably of unitary construction, wherein base plate 22, body 74 and the spaced-apart parallel supports 42 are of integral, one piece construction.

As best seen in FIGS. 1–5, the only components of the pedal exposed above the floor 25 are the base plate 22 and the upper treadle portion 26. The majority of the springs 40 as well as the pedal position sensor 66 and drive link components associated therewith are all disposed beneath the floor 25. As a result of this arrangement, the throttle pedal possesses a very low, uncluttered profile presenting minimal obstructions above the floor 25, while the more vulnerable portions of the pedal, such as the sensor 66, are mounted beneath the floor 25, isolated from the environment of the passenger compartment of the vehicle. The construction described above is also advantageous in that a low profile pedal is provided with a minimum number of component parts. Moreover, in order to adapt the pedal for varying applications where different inclinations of the upper treadle portion 26 are needed, only one component part need be changed, i.e. the treadle 24. The pedal construction described above is particularly advantageous for use in industrial or off-road vehicles where the pedal is often operated by an operator either in a seated, partially standing or standing position, due to its low profile, i.e. relatively low angle of inclination at the closed throttle position.

From the foregoing, it is apparent that the electronic throttle control pedal described above not only provides for the reliable accomplishment of the objects of the invention, but does so in a particularly economical and efficient manner. It is recognized, of course, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

What is claimed is:

1. An electronic throttle pedal assembly of a vehicle, comprising:

a base mounted on the floor of said vehicle;

a treadle having an upper portion adapted to be contacted by the operator of said vehicle, and having a lower portion extending downwardly through said floor;

a first pivotal connection mounting said treadle on said base for pivotal motion about a first axis;

an electrical sensor for sensing the pivotal position of said treadle and producing an output signal related to the sensed position of said treadle;

linkage drivingly connecting said lower portion of said treadle with said sensor.

2. The throttle pedal assembly of claim 1, wherein:

said base includes a plate overlying said floor, and at least one support on the bottom of said plate extending downwardly beneath said floor, said sensor includes a rotatable input shaft, and said linkage includes first and second interconnected links for translating pivotal movement of said treadle into pivotal movement of said sensor input shaft.

3. The throttle pedal assembly of claim 2, wherein said lower portion of said treadle is mounted by said pivotal connection on said support.

4. The throttle pedal assembly of claim 3, wherein:

one-end of said first link is pivotally connected to said lower end of said treadle, said second link includes a crank arm, and the opposite end of said first link is pivotally connected to said crank arm.

5. The throttle pedal assembly of claim 1, wherein said treadle includes an intermediate, arcuate portion between said upper and lower portions thereof.

6. The throttle pedal assembly of claim 2, including at least one compression spring captured between said base and said treadle, said spring biasing said treadle to pivot toward one extreme pivotal position thereof.

7. The throttle pedal assembly of claim 6, wherein said base includes a pocket formed therein below said floor, and said spring is seated within said pocket.

8. A low profile electronic throttle pedal assembly of a vehicle, comprising:

a base plate mounted on a floor of said vehicle, said plate having an opening therein providing access to an area beneath said floor;

a treadle having an upper portion above said plate, and a lower portion extending downwardly through said opening to said area beneath said floor;

a hinge mounting said treadle for pivotal movement between a closed throttle position and a wide open throttle position;

a sensor mounted beneath said floor for sensing the pivotal position of said treadle and outputting an electrical signal related to the sensed position of said treadle.

9. The throttle pedal assembly of claim 8, wherein said hinge is formed on one end of said plate adjacent said opening in said plate.

10. The throttle pedal assembly of claim 8, including a drive assembly connected between said lower portion of said treadle and said sensor.

11. The throttle pedal assembly of claim 10, wherein said drive assembly includes:

a first drive link having one end thereof pivotally connected to said lower portion of said treadle, a second drive link having one end thereof pivotally connected to the opposite end of said first link, the other end of said second link being drivingly connected to said sensor.

12. The throttle pedal assembly of claim 10, wherein:

said hinge is formed on said plate adjacent said opening, and said lower portion of said treadle extends downwardly from said hinge and forms a lever arm for transmitting force to said drive assembly.

13. The throttle pedal assembly of claim 8, including at least one compression spring engaging said upper portion of said treadle, and wherein said plate includes a pocket therein, said spring being seated within said pocket.

14. The throttle pedal assembly of claim 8, wherein said upper portion of said treadle extends substantially parallel to said plate when said treadle is in said wide open throttle position thereof.

15. The throttle pedal assembly of claim 8, wherein said hinge includes:

a clevis on one end of and formed integral with said plate, a mounting ear formed on and integral with said treadle, and a clevis pin pivotally mounting said ear on said clevis.

16. The throttle pedal assembly of claim 8, wherein said sensor is mounted on the bottom of said plate.

17. An electronic throttle control pedal assembly of a vehicle, comprising:

a base mounted on a floor of said vehicle and including a lower portion disposed beneath said floor;

a treadle mounted on said base for pivotal movement between a closed throttle position and a wide open throttle position, said treadle including an upper portion and a lower portion extending downwardly beneath said floor;

at least one compression spring for biasing said treadle toward said closed throttle position, said spring engaging said upper treadle portion and seated within said lower portion of said base; and, a position sensor for sensing the position of said treadle and generating an electrical signal indicative of said treadle position.

18. The throttle pedal assembly of claim 17, wherein said base includes a recess therein and said spring is captured within said recess.

19. The throttle pedal assembly of claim 18, wherein said base includes:

a base mounting plate adapted to be mounted over said vehicle floor, an opening in said base plate through which said lower portion of said treadle extends, and a pivotal support adjacent said opening for pivotally mounting said treadle on said base, said lower portion of said base, said plate and said pivotal support being of unitary construction.

20. The throttle pedal assembly of claim 17, including a link assembly mounted on said lower portion of said base and drivingly connecting said lower portion of said treadle with said sensor.

* * * * *